US006768271B2

(12) United States Patent
Busse et al.

(10) Patent No.: US 6,768,271 B2
(45) Date of Patent: Jul. 27, 2004

(54) BALLAST AND METHOD FOR OPERATING A LAMP

(75) Inventors: Olaf Busse, Munich (DE); Markus Heckmann, Munich (DE); Wolfram Sowa, Munich (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 0 days.

(21) Appl. No.: 10/334,790

(22) Filed: Jan. 2, 2003

(65) Prior Publication Data

US 2003/0137256 A1 Jul. 24, 2003

(30) Foreign Application Priority Data

Jan. 2, 2002 (DE) ..... 102 00 047

(51) Int. Cl.[7] ..... H05B 37/02

(52) U.S. Cl. ..... 315/209 R; 315/225; 315/283; 315/291; 315/DIG. 7

(58) Field of Search ..... 315/209 R, 200 R, 315/224, 225, 246, 283, 287, 291, 362, DIG. 2, DIG. 5, DIG. 7

(56) References Cited

U.S. PATENT DOCUMENTS

| | | | | | |
|---|---|---|---|---|---|
| 5,381,076 | A | * | 1/1995 | Nerone | 315/209 R |
| 5,426,350 | A | * | 6/1995 | Lai | 315/244 |
| 5,677,602 | A | * | 10/1997 | Paul et al. | 315/224 |
| 5,696,431 | A | * | 12/1997 | Giannopoulos et al. | 315/308 |
| 6,380,694 | B1 | * | 4/2002 | Uchihashi et al. | 315/244 |
| 6,518,712 | B2 | * | 2/2003 | Weng | 315/209 R |
| 2002/0030456 | A1 | * | 3/2002 | Kim | 315/307 |
| 2002/0145393 | A1 | * | 10/2002 | Hui et al. | 315/224 |

* cited by examiner

*Primary Examiner*—Thuy Vinh Tran

(57) ABSTRACT

The invention relates to a ballast for a lamp having an inverter which includes at least one switch (S1; S2), and having a drive circuit (10) for alternately opening and closing the at least one switch (S1; S2) wherein the drive circuit (10) is designed to drive the at least one switch (S1; S2) alternately at at least two different frequencies ($\omega_a$, $\omega_b$). It also relates to a method for operating a ballast for a lamp having an inverter which comprises at least one switch (S1; S2), and having a drive circuit (10) for alternately opening and closing the at least one switch (S1; S2) wherein the drive circuit drives the at least one switch (S1; S2) alternately at at least two different frequencies ($\omega_a$, $\omega_b$).

10 Claims, 1 Drawing Sheet

BALLAST AND METHOD FOR OPERATING A LAMP

TECHNICAL FIELD

The present invention relates to a ballast for a lamp having an inverter which comprises at least one switch, and having a drive circuit for alternately opening and closing the at least one switch, and to a method for operating such a ballast.

Prior art

In ballasts, which are controlled directly by a microcontroller without any further signal conversion, the possible operating frequencies cannot be chosen in indefinitely fine steps. Due to the restrictions of the hardware, in which particular mention should be made of the register width and processor clock, only a specific fixed number of possible operating frequencies can be produced. When changing from one discrete frequency to the next, for example as a result of control processes, this results in abrupt brightness changes of the connected lamp, which may be regarded as being disturbing.

One possible way to counteract this is to increase the clock frequency of the processor and to use broader registers to refine the steps such that the remaining sudden brightness changes are no longer conspicuous. However, this is generally undesirable for cost reasons. Typical solutions for this problem therefore generally provide for the signal supply from the microcontroller to be converted from digital to analogue form. In this case, the output signal from the processor is normally integrated using a capacitor. The resultant voltage then controls an oscillator, for example a VCO (Voltage Controlled Oscillator). The frequency of the VCO can be adjusted in very fine steps. However, the costs incurred here are also still considerable.

DESCRIPTION OF THE INVENTION

The object of the present invention is therefore to develop a ballast of the type mentioned initially, as well as the method mentioned initially for operating a ballast, such that abrupt brightness changes of a connected lamp can be avoided in a cost-effective manner.

This object is achieved by a ballast having the features of patent claim 1, and by a method for operating a ballast having the features of patent claim 8.

The invention is based on the knowledge that the integration of the changing light brightness is not carried out using a capacitor provided for this purpose, but by the inertia of human perception. A periodically fluctuating lamp brightness is not perceived if the fluctuation frequency is more than 80 Hz. Any perceivable brightness between the fixed predetermined discrete values can be produced by switching between at least two different frequencies.

The drive circuit is preferably designed to carry out a change between the different drive frequencies at a switching frequency which is chosen such that the different lamp brightnesses, which are correlated with the different drive frequencies, can no longer be resolved by a human eye. The switching frequency is thus preferably at least 60 Hz, and in particular at least 80 Hz.

A mains rectifier may be connected upstream of the inverter, and may be fed from an AC voltage mains system which is at a mains frequency, with the switching frequency being synchronized to the mains frequency. This is because, if ripple occurs at the mains frequency or at multiples of it in the ballast, low beat frequencies can occur if the drive is not synchronized, whose frequency may be so low that these frequencies can once again be perceived by the human eye. By way of example, the mains frequency is 50 Hz or 60 Hz, and the corresponding switching frequencies are then multiples of 50 Hz, in particular 100 Hz, or multiples of 60 Hz, in particular 120 Hz. Alternatively, it is also possible to provide for the mains frequency to be a multiple of the switching frequency.

When the ballast is operated from a DC voltage source, for example from batteries, no synchronization is required with externally produced frequencies. In this case, a switching frequency is chosen which can be implemented well technically and is at the same time greater than the flicker frequency which can still be perceived by the human eye.

Further advantageous developments of the invention are defined in the dependent claims.

DESCRIPTION OF THE DRAWINGS

An exemplary embodiment will be described in more detail in the following text, with reference to the attached drawings, in which:

FIG. 1 shows a ballast for operating a lamp La. A first and a second switch S1; S2 are arranged between the supply voltage $V_{CC}$ and ground. The center point between the two switches S1, S2, which are preferably in the form of transistors, is connected via a coupling capacitor $C_K$ to the output circuit, which comprises an inductance L as well as a capacitor C. The switches S1; S2 are opened and closed by a drive circuit 10, which is designed to drive the two switches S1; S2 alternately at at least two different frequencies. The switching frequency between the two drive frequencies is at least 60 Hz, and preferably at least 80 Hz.

FIG. 2 shows the time profile of the power $P_L$ consumed in the lamp, which is correlated with the brightness emerging from the lamp, plotted against the frequency $\omega$. The frequency $\omega$ is, for example, between 25 kHz and 125 kHz. A first frequency $\omega_a$ is correlated with a first lamp power $P_a$, a second frequency $\omega_b$, which is greater than $\omega_a$, is correlated with a second lamp power $P_b$ which is less than the lamp power $P_a$. $\omega_a$ and $\omega_b$ are two discrete successive drive frequencies, which can be produced in the drive circuit 10. Switching backwards and forwards directly between the lamp power $P_a$ and the lamp power $P_b$ in the course of a control process would lead to sudden brightness changes, which can be perceived by a human eye.

FIG. 3 shows first of all the time profile during operation of the ballast either at the lamp power $P_a$ or at the lamp power $P_b$, with the mains frequency of the voltage mains system from which the ballast is driven being reflected in the form of ripples in the time profile of the mains frequency. According to the invention, the ballast is operated at a lamp power $P_a$ during a time period $t_a$, and at the lamp power $P_b$ during a time period $t_b$. The switching between the lamp power $P_a$ and the lamp power $P_b$ is synchronized to the ripples, although the switching need not necessarily take place at the respective maxima. The resultant mean lamp power $P_m$ is accordingly $$P_m=(t_a*P_a+t_b*P_b)/(t_a+t_b)$$

Figure 1:
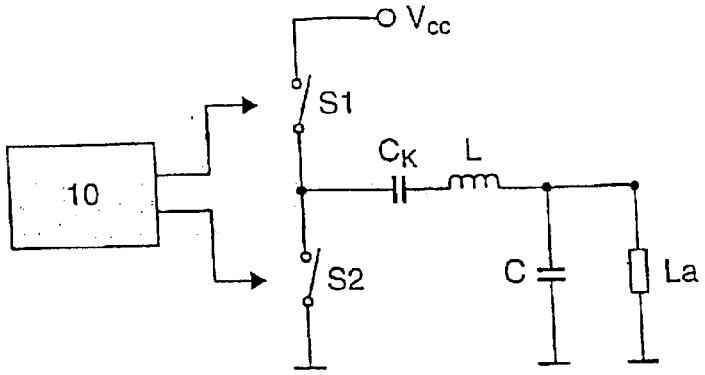
FIG. 1 shows a schematic illustration of one exemplary embodiment of a ballast according to the invention.
Figure 2:
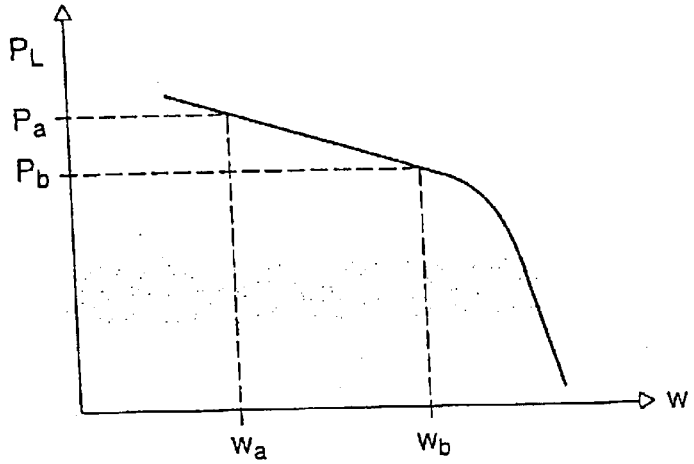
FIG. 2 shows a schematic illustration of the power which is consumed in the lamp, as a function of the frequency $\omega$.
Figure 3:
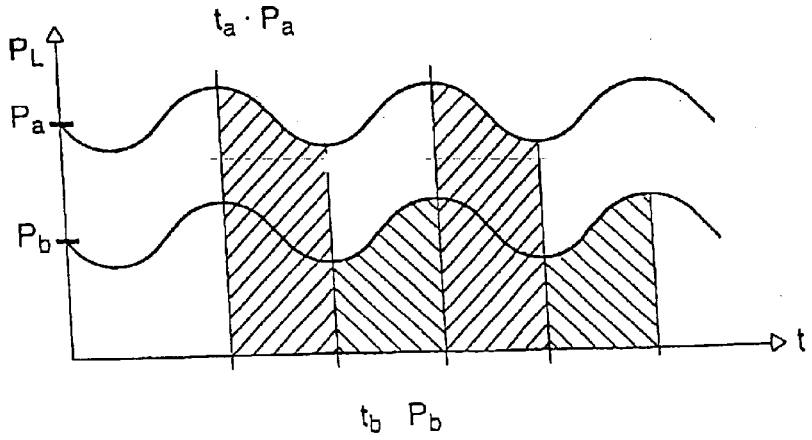
FIG. 3 shows the time profile of the power which is consumed in the lamp, for a ballast according to the invention.

The shaded areas in FIG. 3 show the profile of the lamp power with a ballast according to the invention.

When the ballast is operated with a DC voltage source, no synchronization is required, of course. In this case, the switching frequency between the lamp power $P_a$ and the lamp power $P_b$ is chosen such that it is higher than the flicker frequency which can be perceived by a human eye.

What is claimed is:

1. A ballast for a lamp having an inverter which comprises at least one switch (S1; S2), and having a drive circuit (10) for driving the at least one switch (S1; S2), wherein (i) during steady-state operation following ignition of the lamp (La), the drive circuit (10) drives the at least one switch (S1; S2) alternately at at least two different drive frequencies ($\omega_a$, $\omega_b$);

(ii) the drive circuit (10) periodically changes between the different drive frequencies ($\omega_a$, $\omega_b$) at a switching frequency; and (iii) the switching frequency is chosen such that resulting fluctuation in the brightness of the lamp (La) cannot be visually perceived by a human eye.

2. The ballast as claimed in claim 1, characterized in that the switching frequency is at least 80 Hz.

3. The ballast as claimed in claim 1, characterized in that the switching frequency is a multiple of a mains frequency.

4. The ballast as claimed in claim 3, characterized in that the mains frequency is 50 Hz and the switching frequency is 100 Hz.

5. The ballast as claimed in claim 3, characterized in that the mains frequency is 60 Hz and the switching frequency is 120 Hz.

6. A method for operating a ballast for a lamp having an inverter which comprises at least one switch (S1; S2), and having a drive circuit (10) for alternately opening and closing the at least one switch (S1; S2), the method comprising the steps of:

igniting the lamp (La); and operating the lamp (La) in a steady-state mode wherein:

(i) the drive circuit (10) drives the at least one switch (S1; S2) alternately at at least two different drive frequencies ($\omega_a$, $\omega_b$);

(ii) the drive circuit (10) periodically changes between the different drive frequencies ($\omega_a$, $\omega_b$) at a switching frequency; and (iii) the switching frequency is chosen such that resulting fluctuation in the brightness of the lamp (La) cannot be visually perceived by a human eye.

7. The method of claim 6, wherein the switching frequency is at least 80 Hz.

8. The method of claim 6, wherein the switching frequency is a multiple of a mains frequency.

9. The method of claim 8, wherein the mains frequency is 50 Hz and the switching frequency is 100 Hz.

10. The method of claim 8, wherein the mains frequency is 60 Hz and the switching frequency is 120 Hz.

* * * * *